United States Patent [19]

Elsässer et al.

[11] Patent Number: 4,798,064

[45] Date of Patent: Jan. 17, 1989

[54] CAM SEGMENT FOR A KNITTING MACHINE

[75] Inventors: Martin Elsässer, Stuttgart; Erwin Schäberle, Gäufelden, both of Fed. Rep. of Germany

[73] Assignee: Sulzer Morat GmbH, Fed. Rep. of Germany

[21] Appl. No.: 175,927

[22] Filed: Aug. 29, 1980

Related U.S. Application Data

[63] Continuation-in-part of Ser. No. 952,329, Oct. 18, 1978, abandoned.

[30] Foreign Application Priority Data

Oct. 18, 1977 [DE] Fed. Rep. of Germany ..... 2746725

[51] Int. Cl.[4] ..... D04B 15/32

[52] U.S. Cl. ..... 66/57

[58] Field of Search ..... 66/57, 78

[56] References Cited

U.S. PATENT DOCUMENTS

| | | | |
|---|---|---|---|
| 1,311,093 | 7/1919 | Scott | 66/57 |
| 3,386,268 | 6/1968 | Beckenstein | 66/57 X |
| 3,882,694 | 5/1975 | Stepanek et al. | 66/57 X |
| 3,961,499 | 6/1976 | Stepanek et al. | 66/57 X |
| 4,231,234 | 11/1980 | Schmid et al. | 66/57 X |
| 4,307,586 | 12/1981 | Schmidt | 66/54 X |

FOREIGN PATENT DOCUMENTS

| | | | |
|---|---|---|---|
| 1099120 | 2/1961 | Fed. Rep. of Germany | 66/57 |
| 2225865 | 12/1972 | Fed. Rep. of Germany | 66/57 |
| 2544197 | 4/1977 | Fed. Rep. of Germany | 66/57 |
| 367925 | 4/1963 | Switzerland | 66/78 |
| 1398602 | 6/1975 | United Kingdom | 66/57 |
| 1406262 | 9/1975 | United Kingdom | 66/57 |

*Primary Examiner*—W. C. Reynolds

[57] ABSTRACT

The invention relates to a cam segment with an assembly device for the assembly of cam sections. To facilitate the production and assembly, the assembly device comprises a receiving plate or at least one spacing disc fitted on a receiving plate, such that in the assembly surfaces of the cam sections and of the receiving plate and/or of the spacing disc, which are made by stamping and/or punching and/or fine blanking, recesses are formed in such a manner and/or locating pins protruding into said recesses are formed such that the position of the cam sections on the cam segment are clearly established by the locating pins and recesses.

2 Claims, 3 Drawing Sheets

CAM SEGMENT FOR A KNITTING MACHINE

This is a continuation-in-part of application Ser. No. 952,329, filed Oct. 18, 1978 now abandoned.

The invention relates to a cam segment for a knitting machine with an assembly device which is attached to the knitting machine and having a first element with an assembly surface, with at least one second element, comprising a cam section, which is fitted to the first element and in the assembled state has an assembly surface facing the assembly surface of the first element, and with locating means in the form of locating pins and recesses, such that the locating pins being made in one piece with one of the two elements and engaging in recesses of the other element.

On knitting machines, especially those with interchangeable cam sections for the purpose of producing knit-goods with different patterns, there is a need for cam sections and/or cam segments to be located and secured at any feeder of the knitting-machine, without complicated and time-consuming adjustments. If the usual fitting pins were used for this purpose, having to be inserted in precision located slots or holes in the cam sections and receiving plates used for the assembly of same, not only is the initial fitting of the knitting machine with cam sections involved with time-consuming adjustment work and down times, but also any subsequent re-equipping with other cam sections.

For this reason, cam segments of the above described type are already known (German Pat. No. OLS 2 225 865, U.S. Pat. Nos. 1,398,602 and 1,406,262), with which the cam sections are provided with locating pins and the receiving plates are provided with grooves to receive the locating pins, said grooves running vertically to the needle stroke direction. A disadvantage with such cam segments is that the grooves and locating pins allow only for a vertical fixing of the cam sections on the receiving plate, and moreover, the making of the grooves is very costly and that the cam sections are produced by sintering.

With another known form of cam segment (U.S. Pat. No. 4,231,234), which has stamped out cam sections and receiving plates, locating pins are provided on the receiving plate, said pins resting against the outer rim of the cams in the assembled state. Admittedly, this provides for simple production, but it has the disadvantage that only such cams can be fitted on the receiving plate without requirement for adjustment and outer contours of which can set in conjunction with the locating pins having a given arrangement.

Moreover, in many cases, cam segments incorporate stitch cams wihich are attached to adjustable slides, and for this purpose, have grooves in their backs, the width of which corresponds to the width of the slides. These stitch cams must have a certain minimum thickness for technical processing reasons, and this minimum thickness must not be undercut, so that all other cams fitted on the same receiving plate, must also be of a certain minimum thickness, so that their external surfaces lie in roughly the same plane as the external surfaces of the adjustable stitch cams. This has the unpleasant consequence that, although these cams can be produced by stamping, this production method is accompanied by time-consuming and expensive upgrading work, especially grinding, so that the advantages accruing from stamping are substantially annulled. One cause for this can be seen, for example, in that the cams must be made of hard wearing material, e.g. tool steel, which below a certain minimum thickness is subject to hairline cracking at the surface, which has to be removed by grinding. For this reason, the initially mentioned cam segments offer substantial advantages on the one hand, with regard to locating of the cams, but offer only slight advantage with regard to the production of the cams.

The aim of the invention is therefore to develop the initially described cam segment such that it can be produced by stamping and/or punching and/or fine blanking without difficulty and with only slight upgrading work. In addition, the cam segment according to the invention is designed such that its cams can be interchanged without expensive or time-consuming adjustment work and can be fitted at any knitting feeder of a machine.

To receive these problems, the invention is characterized in that the second element consists of a cam section, made by stamping and/or swaging and that the locating pins and the recesses are designed and arranged such that they clearly establish a preselected position of the second element on the first element.

The word "stamped" as used in the following specification and claims shall also encompass similar words used in the art, e.g. "punching", "fine blanking" or "swaging".

The invention affords the advantage that the cams can be located by means of a single locating pin and a corresponding recess on the receiving plate. To secure the cams on the receiving plate, securing screws may be used, which protrude through openings in the cams with a relatively large amount of play. Moreover, since the stamping and/or punching and/or fine blanking technique enables the locating pins and/or recesses to be arranged at a quite specific position of the receiving plate and of the cams, every cam can be fitted to any receiving plate, without any changes taking place in its position relative to the receiving plate. Finally, if receiving plates are used, which are provided with locating means according to German Pat. No. OLS 2 544 197 for locating on the knitting machine, then any receiving plate can also be fitted on any knitting feeder.

According to embodiments of the invention, provision is made between the receiving plates and cams for distance discs, which are either made in one piece with the receiving plates or with the cams or are in the form of separate elements. This provides for an additional advantage that the cams which, with their assembly surfaces normally rest on the assembly surface of the receiving plate, can be made much thinner than usual, which facilitates their production on normal stamping and/or punching and/or fine blanking machines.

Other advantageous features of the invention are characterized in the sub-claims.

The invention will now be described more fully in conjunction with the attached drawings and on the basis of embodiment examples:

FIG. 8 is a section along the line VIII—VIII of FIG. 1.

Figure 1:
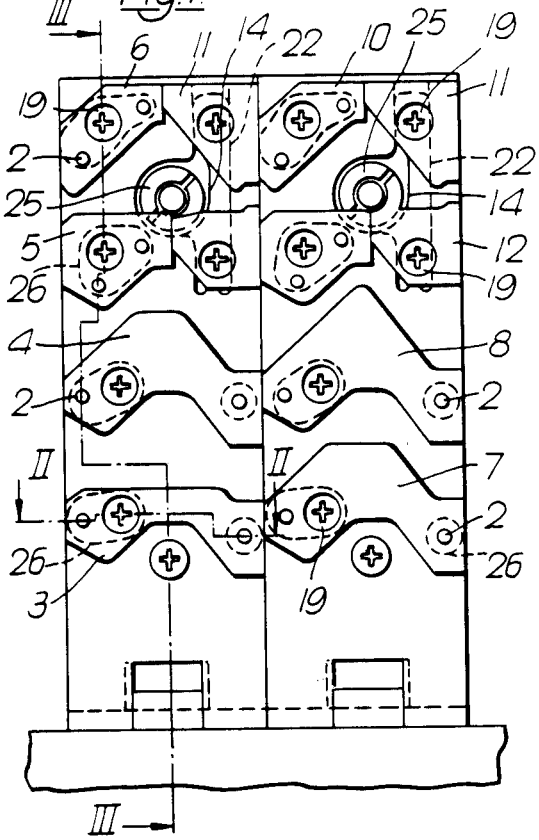
FIG. 1 is a plan view of two receiving plates fitted with cams for the cylinder cam box ring of a circular kniting machine according to one embodiment of the invention.

According to FIG. 1, every knitting system or feeder of a cylinder cam box ring of a circular knitting machine has a receiving plate 1, comprising a stamped out and/or punched out plate which during the stamping and/or punching and/or fine blanking operation, is provided with a plurality of raised locating pins 2 arranged on its assembly surface. These pins 2 serve to hold and locate cams of like or different function said cams also having assembly surfaces which face the assembly surface of plate 1. For example, on the left receiver plate 1 in FIG. 1, at the lowest level, there is arranged a 'pass through' cam 3, a 'tuck cam' 4 at the second level from the bottom, another 'pass through' cam 5 above that, on the top level, a guide cam 6 while on the right receiving plate in FIG. 1, on the same levels, there is a 'tuck' cam 7, a raising cam 8, a 'pass through' cam 9 and a guide cam 10. The said cams from guide tracks in known manner for the pattern butts of knitting needles or jacks fitted in corresponding levels and said needles or jacks being inserted in the tricks of a needle cylinder (not illustrated). The receiving plate 1 may also serve to position the cams of at least two knitting systems.

In the two upper ends of the receiving plates 1, other known types of cams are contained, similarly acting on the butts of knitting needles or jacks; these are, in the uppermost level, a stitch cam 11, and in the next levels down, a 'pass through' or guide cam 12. Cams 11 and 12 bring about in known manner, the stitch formation and are therefore attached to a slide 14, adjustable in the direction of the needle stroke. In this way, the stitch length can be altered.

Figure 2:
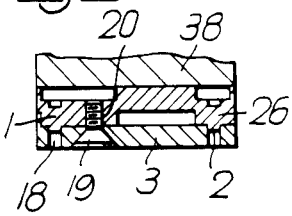
FIGS. 2 and 3 show sections along the lines II—II and III—III of FIG. 1.
Figure 3:
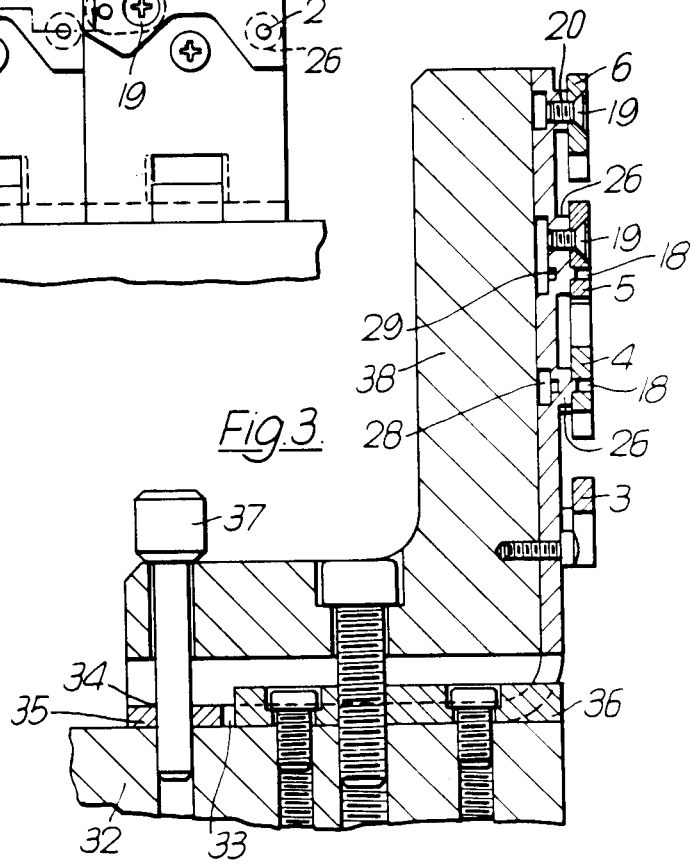

As clearly shown in FIGS. 2 and 3, all cams, with the exception of cams 11 and 12, each have two openings or recesses 18 passing right through and adjoining the assembly surfaces thereof, the cross section of which accurately corresponds to the cross sections of the holding pins 2 and which serve to fit the cams on the holding pins 2 and thus to accurately, i.e., non-rootatably and non-slidably, locate them on the receiving plates 1 into a selected needle guidance position, without the need for additional adjustment. To secure the cams to the receiving plate 1, securing screws 19 are provided, which pass through holes or recesses of the cams with a degree of play and are screwed into the threaded holes 20 in the receiving plate 1 which holes 20 adjoin the assembly surface thereof. The recesses in the cams may allow a relatively large amount of play for the screws 19, because the position of the cams is clearly established by the holding pins 2 and the recesses 18.

The slides 14 are guided in the elongated sections of openings 22 in the receiving plates and consequently, accurately fixed in their position relative to the receiving plates 1 in the direction normal to the needle stroke direction, while at the same time still being movable in the needle stroke direction. To accurately locate the cams 11 and 12 on the slides 14, grooves are machined in the surfaces of these cams facing the slides 14. These grooves accurately accommodating the section of the slide 14 which protrudes through the openings 22 in the assembled condition, so that screws 19 can be used to secure same, and these screws 19 can pass with play, through the openings provided in the cams 11 and 12. An adjustment mechanism for the slide 14 is simply indicated in FIG. 1 by a nut 25.

Formed at a right angle on the back of the slide 14 is a guide plate 55 (FIG. 8), which projects into a recess 56 of a segment 57, has an oblong middle opening 58 and carries two backwardly projecting pins 59, between which is arranged a cam disc 60. The cam disc 60 is connected rotationally fast by means of a pin connection to the wide middle portion of an adjusting screw 61, which projects through a central offset drill hole of the segment 57, and the rearwardly projecting head of which is provided with a hexagonal hole 62 or the like, so that it can be rotated from the back of the segment 57. On its other end, the adjusting screw 61 has a first portion of reduced diameter on which the cam disc 60 is mounted and which is adjoined by a screw threaded portion, which projects through the central opening 58 and on which the nut 25 is screwed from the other side of the guide plate 55. Finally, pushed on the wide central part of the adjusting screw 61 is at least one cup spring 63 supported between the head of the adjusting screw and a wall section of the offset drill hole of segment 57, and thus prestresses the adjusting mechanism comprising the slide 57, guide plate 55, cam disc 60, adjusting screw 61 and nut 25, such that the knitting lock parts 11 and 12 always bear on the assembly plate 1, independently of the rotary position of the nut 25.

Further details of the adjusting mechanism can be obtained from German Pat. No. OLS 25 44 197, to which reference is expressly made at this point.

Because of the grooves, formed in the rear section of the cams 11 and 12, serving to accommodate the slides 14, cams 11 and 12 must be of a certain minimum thickness which must not be undercut. The consequence of this is that the other cams 3 to 10, which rest with their assembly surfaces on the assembly surface of the receiving plate, must be at least of equal thickness, since otherwise, the outer surfaces of all cams would not lie in the same plane. This is the reason why the cams, although they can be made by stamping or fine blanking, extensive upgrading work has to be carried out after the stamping operation, and this could wholly or significantly detract from the advantages of the stamping/fine blanking technique.

According to the invention, the holding pins are therefore made as part of the distance discs 26 which are arranged on the receiving plate 1 and according to FIGS. 1 to 3, are an integral part thereof. It can also be seen from FIGS. 1 to 3 that the distance discs 26 are of different size and shape and can accommodate not only more than one locating pin 2, but also elongations of the threaded holes 20 for the securing screws 19. The outer shape of the spacing discs 26 is preferably circular or oval, although any other desired shape is feasible.

Distance discs 26, together with the locating pins 2 are produced in a combined stamping/fine blanking process during the manufacture of the receiving plates 1. Thus the manufacture of the receiving plates 1 takes place for example, in that at first, by means of a following tool, receiving plates are out or punched out in the desired shape from sheet steel, while at the same time, by a stamping and/or fine blanking process, the distance discs 26 can be made in the one piece, so that on the rear of the receiving plate 1, corresponding recesses 28 (FIG. 3) are formed. After the following flat grinding on a planing machine, the locating pins are formed in another machine tool by means of a further stamping or fine blanking process, so that the locating pins 2 are part of the spacing discs 26, which leads to corresponding recesses 29 (FIG. 3) in the spacing discs 26. Finally, the receiving plates 1 are treated on a finish grinding machine and then tempered. The assembly plate 1 and the spacing discs 26 may also be made of plastic by injection molding.

The production of the cams 3 to 10 is also quite simple, in that these cams are stamped or punched out from strip steel and at the same time, also by stamping or fine blanking, the recesses 18 are formed. Thereafter, the cams are treated on a finish grinding machine and tempered.

Due to the fact that the locating pins 2, the distance discs 26 and the recesses 18 are produced by stamping or fine blanking their positions can be precisely fixed without the need for costly boring and machining work. Moreover, the locating pins 2 can be provided at such places on the receiving plates 1 that they can be used to accommodate corresponding recesses 18 of all relevant cams. Therefore, if after completion of the whole cam segment, other cams are to be fitted than had initially been envisaged, one need only ensure in the production of these other cams that the recesses 18 are arranged in the positions, corresponding to the locating pins 2 during stamping, and this should not raise any problems.

For the precise fixing and positioning of the receiving plates 1 and the cams attached thereon, on to a cam base plate 32 (FIG. 3) of the circular knitting machine, recesses 33 and 34 are provided. These recesses 33 and 34 are similarly formed by stamping or punching in a section 35 of the receiving plates 1 which is bent over at right angles. Recess 33 serves to accommodate a locating or fitting means 36 attached to base and recess 34 serves to accommodate an adjusting bolt 37, protruding into the cam base plate 32. Moreover, the reverse sides of the receiver plates 1 may also be covered with segments 38. The various operations required to fix and locate the receiver plates 1 on the cam base plate 32 are described comprehensively in the already mentioned German Pat. OLS No. 25 44 197.

Figure 4:
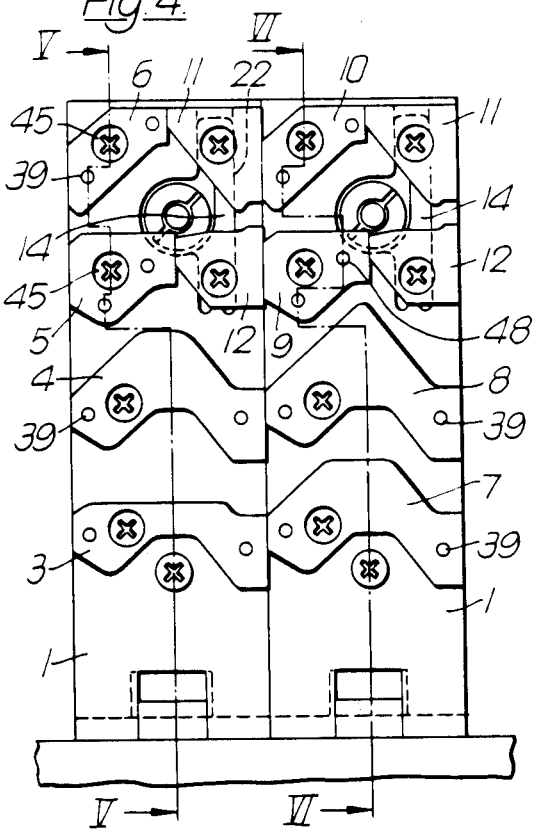
FIG. 4 is a plan view of two receiving plates fitted with cams for the cylinder cam box ring of a circular knitting machine according to a second embodiment of the invention.
Figure 6:
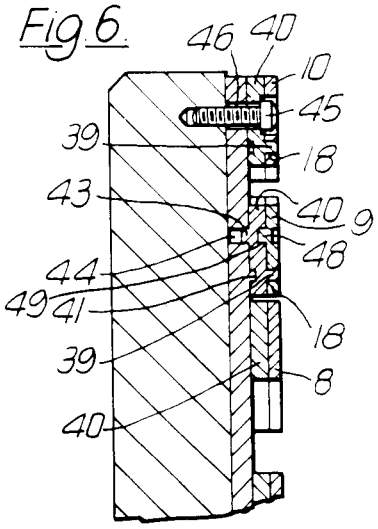
FIGS. 5 and 6 show sections along the lines V—V and VI—VI of FIG. 4.
Figure 5:
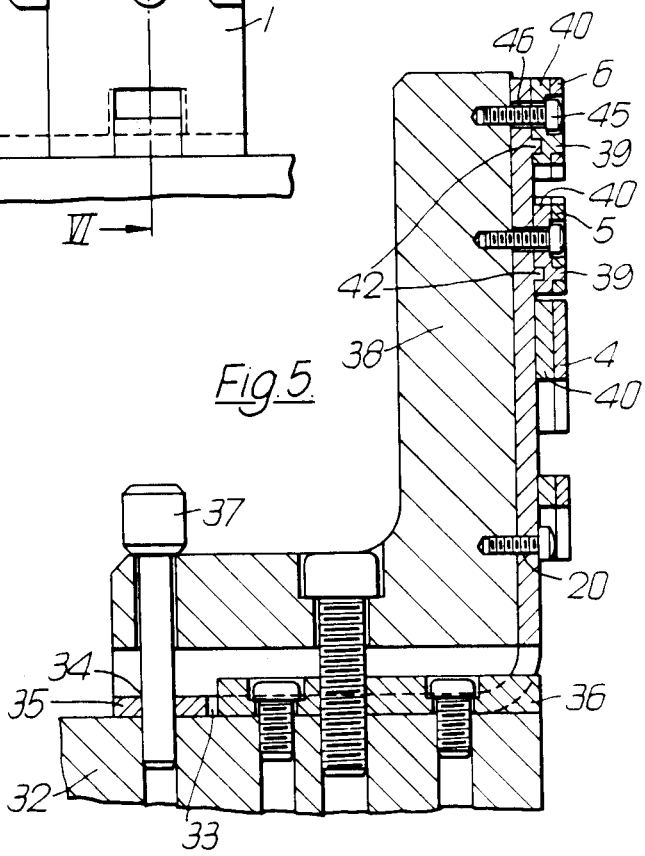

If for some reason, it should prove disadvantageous or undesirable to make the spacing discs 26 and the locating pins 2 as integral parts of the receiver plates 1, then the arrangement shown in FIGS. 4 to 6 may be adopted. The parts carry the same numerical designations as above.

In contrast to FIGS. 1 to 3, provision is made in the arrangement according to FIGS. 4 to 6 for locating pins 39 to be formed on spacing discs 40, produced independently of the receiver plates 1. As clearly illustrated in FIGS. 5 and 6, and described here by way of example, for each cam a separate spacing disc 40 is provided, on which at least locating pins 39 are formed as integral parts and which, in the same way as the locating pins 2, protrude through recesses 18 (FIG. 6) into the stamped out cams to locate them accurately. In order to exactly position and for non-rotatably and non-slidably orientating the distance discs 40 on the receiver plates 1, either locating pins 42 (FIG. 5) are used, where the said pins 42 are attached to the receiver plates 1 and protrude in suitable openings 41 (FIG. 6) in the spacing discs 40, or locating pins 43 (FIG. 6) are used, where the said pins 43 are formed on the spacing discs 40 and protrude in suitable openings 44 (FIG. 6) into the receiver plates 1. Both the locating pins 39, 42, and 43 as well as the openings 18, 41 and 44 can be produced by simple stamping or stamping and punching processes during the manufacture of the receiver plates 1, cams or spacing discs 40. With regard to the spacing discs 40, there is the additional advantage that mild steel can be used to make them instead of the hard wearing material, e.g. tool steel, required for the cams so that the thickness of the spacing discs need not be taken into consideration.

To secure the cams 3 to 10 together with the distance discs 40, screws 45 are provided, which according to FIGS. 1 to 3, pass with a degree of play through recesses in the cams and distance discs and are screwed into threaded holes 46 in the receiver plate 1. Distance discs 40 are preferably rivetted or bonded with the cams 3 to 10 in order to make up one component for assembly purposes. As indicated in FIG. 6, one embodiment of this form of the invention includes the outer contours of the discs 40 coincident with the outer contours of the overlying cams 3 to 10.

Figure 7:
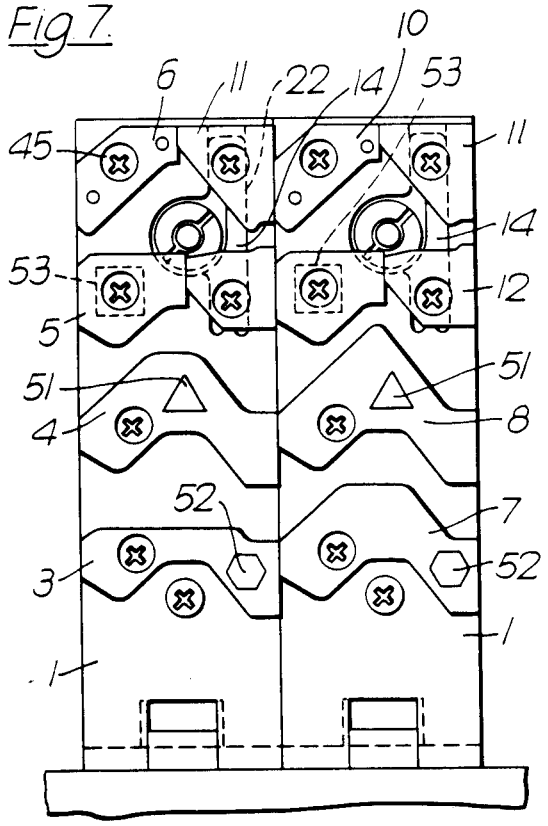
FIG. 7 is a plan view of two receiving plates fitted with cams according to a third embodiment of the invention.

The embodiment according to FIG. 7 differs from the embodiment shown in FIG. 4 only in as much as the cross section of the locating pins is concerned. For this reason, the parts are designated with the same numerals in both FIGS. 4 and 7. Whereas the locating pins 39 and also the other positioning pins depicted in the drawing are circular in cross section, the receiver plate 1 according to FIG. 7 has locating pins 51 and 52 with triangular and/or hexagonal cross section and corresponding cross sections are also possessed by those openings in the cams 3 to 10, into which the triangular or hexagonal locating pins 51 to 52 are inserted. As with the embodiments shown in FIGS. 4 to 6, locating pins 51 and 52 and the corresponding holes in the receiver plates, in the spacing discs and/or in the cams can be provided. Contrary to the embodiments shown in FIGS. 1 to 6, this offers the advantage that in each case a single locating pin and a single receiver hole are adequate to clearly establish a preselected position of the cams 3 to 10 on the receiver plates or spacing discs and/or the spacing disc on the receiver plates because the locating pin cannot be rotated and is located in the recesses such that it cannot be displaced in any direction perpendicular to its length axis. Finally, it is possible to provide in the assembly surfaces of the cams, recesses or locating pins with polygonal cross section and in the vicinity of these recesses and locating pins, also to provide for holes for the securing screws 45, as indicated by the reference number 53 in FIG. 7.

The invention is not confined to the example embodiments described, which can in fact be modified in a number of ways. The described locating pins may be attached to the receiver plates, for example, to have such length that they pass through the holes of separate spacing discs and also at least partly through suitably formed holes provided in the cams. Moreover, separate spacing discs can be provided, which are inserted in suitable recesses in the receiver plate 1, such that the external shape acts at least partially with the shape of the recess. Alternatively, the receiver plate could have locating pins which although resting against the outer shape of the spacing discs, are not in contact with the outer shape of the cams. Furthermore, it is not essential that the holes for receiving the locating pins, are not through-going. In fact, so-called blind holes are quite suitable, providing they are of sufficient depth to accommodate the length of the locating pins. The spacing discs 26 according to FIGS. 1 to 3 may be designed to be so small that they can each only accommodate one locating pin 2 or only one threaded hole.

Nor is the invention restricted to the fact that the locating pins are formed only on the receiver plates or spacing discs. An alternative embodiment to that shown in FIGS. 1 to 3 consists of both the locating pins as well as the spacing discs being formed as an integral part of the cams, while the receiver plate simply has corresponding holes/recesses to receive the locating pins. Correspondingly, the holding pins, contrary to the embodiment shown in FIGS. 4 to 6, could be provided on the cams, while the recesses to accommodate these locating pins could be provided in the separate spacing discs. It is furthermore possible in both alternatives, to provide at least one each locating pin 42 and 43 and one recess each on the receiver plate 1 and on the back of the corresponding spacing disc 40 and at least one further locating pin 39 or 48 and one further recess 18 or 49 on each front of the spacing disc 40 or on the corresponding cam 9, as illustrated in FIG. 6 for the locating of a spacing disc 40 on the receiver plate 1 and for locating the cam 9 on this spacing disc 40. Moreover, on the receiver plate and/or on the spacing disc and/or on the cam, two locating pins and slots associated with them could be provided, the length of said slots corresponding to the distance between the two locating pins. Also by this measure, the cams can be accurately positioned in a preselected position on the spacing disc and/or the receiver plate, so that the securing screws can pass through the cams with a degree of play, and be assembled preferably so that there is no rotation and be immovable in directions at right angles to the length axes of the locating means.

With the embodiment according to FIG. 7, instead of triangular or hexagonal cross sections for the locating pins and receiver openings, other cross sections, e.g. oval, can be provided, in order to clearly establish the position of the cam sections. Finally, it is not essential to devise the locating pins and holes/recesses such that the spacing discs are mounted on the receiver plates such that they cannot rotate and be immovable in the directions at right angles to the axes of the locating pins. In fact, it is also possible to allow a locating pin to protrude through a receiver slot. Here too, the position of the cam can be positively located, even when securing screws are provided which pass through the cams with play. Finally, it is not essential to have identical cross sections for the locating pins and receiver holes/-recesses, even if the cams are to be held so as to be non-rotatable and indisplaceable in directions normal to the axes of the locating pins since, for example, triangular cross sections can be combined with other polygonal cross sections.

We claim:

1. A cam device for being mounted on a cam base plate of a knitting machine, comprising: a group of first elements including a plurality of first cam parts, each first element having an opening and being made by stamping and having a first element assembly surface and a first outer surface on opposed sides thereof; a second element for being stationary mounted on a knitting machine, said second element being made by stamping and having a first receiving assembly surface for the stationary and interchangeable mounting of at least one of said first elements at at least one location on the cam device with said first assembly surfaces facing each other; a fastening element for fastening said first element on the cam device at said location and projecting with play through said opening of said first element; and cooperating first positioning means for positioning said first element on said second element before fastening said fastening element, said first positioning means including associated members, one of said members being a recess being defined in one of said first assembly surfaces and the associated member being at least one raised portion for engaging said recess and rising above the other one of said first assembly surfaces, said recess and said raised portion being made by stamping and in one piece with said elements during manufacture thereof and being of such configuration, that said first element may be accurately orientated and held on said second element in a selected needle guidance position at said location before fastening said fastening element, and wherein said second element has at least one spacing disc being defined on said first receiving assembly surface for spacing the first element assembly surface from said first receiving assembly surface in the assembled condition of said first and said second element, said spacing disc being made by stamping and in one piece with said second element during manufacture thereof.

2. A cam device according to claim 1, wherein said raised portion is defined in and rising above said spacing disc, wherein said recess is defined in said first element and wherein said second element, said spacing disc and said raised portion are made by stamping and in one piece during manufacture of said second element.

* * * * *